US005634417A

United States Patent [19]

Katou

[11] Patent Number: 5,634,417

[45] Date of Patent: Jun. 3, 1997

[54] FABRIC PRESSER FOOT DEVICE OF A SEWING MACHINE

[75] Inventor: Yutaka Katou, Kariya, Japan

[73] Assignee: Aisin Seiki Kabushiki Kaisha, Kariya, Japan

[21] Appl. No.: 507,708

[22] Filed: Jul. 26, 1995

[30] Foreign Application Priority Data

Jul. 28, 1994 [JP] Japan ..... 6-177208

[51] Int. Cl.[6] ..... D05B 29/08

[52] U.S. Cl. ..... 112/235; 112/240

[58] Field of Search ..... 112/235, 240, 112/236

[56] References Cited

U.S. PATENT DOCUMENTS

| | | | |
|---|---|---|---|
| 696,012 | 3/1902 | Dimond et al. | 112/235 |
| 1,202,283 | 10/1916 | Gray | 112/235 |
| 2,857,870 | 10/1958 | Knieriemen et al. | 112/240 X |
| 4,630,557 | 12/1986 | Russell | 112/235 |
| 4,679,514 | 7/1987 | Schwaab | 112/235 |
| 5,138,962 | 8/1992 | Klundt | 112/235 X |

FOREIGN PATENT DOCUMENTS

| | | | |
|---|---|---|---|
| 1277128 | 10/1961 | France | 112/235 |
| 56-38239 | 9/1981 | Japan . | |
| 58-41080 | 9/1983 | Japan . | |
| 60-8855 | 3/1985 | Japan . | |
| 6169 | of 1891 | United Kingdom | 112/235 |

*Primary Examiner*—Paul C. Lewis

*Attorney, Agent, or Firm*—Oblon, Spivak, McClelland, Maier & Neustadt, P.C.

[57] ABSTRACT

A presser bar 11 is provided at its lower end with a fabric presser foot 13 and a nut 16. The fabric presser foot 13 is individually moved on the presser bar 11 independent of a reciprocating motion of the presser bar 11. Due to an action of a spring 14 the presser foot 13 is resiliently pressed against a fabric 40 to be sewn to reduce a noise while a needle is associated with a hook or shuttle 26.

2 Claims, 7 Drawing Sheets

FABRIC PRESSER FOOT DEVICE OF A SEWING MACHINE

BACKGROUND OF THE INVENTION

The present invention relates to a fabric presser foot device for a sewing machine, wherein a presser foot movable in a vertical plane is mounted on a lower end of a presser bar.

Generally, a sewing machine is used to sew two superposed fabrics or leathers to be stitched together with a needle taking up a thread. This type of the machine is well known, for example, by Japanese Patent Publication (KOKOKU) No. 41080/1983 wherein a needle bar is arranged in parallel with a fabric presser bar in such a manner that the needle bar is moved upward and downward by synchronizing with a rotation of a main shaft of the machine and the fabric presser bar is movable on the needle bar. Disposed is a coil spring between a frame of the machine and the top of the fabric presser bar so as to press a presser foot formed on a lower end of the fabric presser bar against the fabrics or leathers to be sewn. In this case, when the needle is moved downward toward its dropping position, the coil spring is compressed and the biasing force of this compressed coil spring is exerted upon the fabrics or leathers to be sewn via the fabric presser foot which is moved downward for pressure contact with the fabric on a needle plate.

It is noted in a prior art that the fabric presser foot is forced to be dropped by the biasing force of the coil spring until it comes into collision with the fabric on the needle plate while the moving needle is stuck into the fabric. This collision is repeated at a high frequency so that undesired noise emits.

To eliminate such the noise Japanese Patent Publication (KOKOKU) No. 38239/1981 and Utility Model Publication (KOKOKU) No. 8855/1985 propose a fabric presser foot device as shown in FIGS. 7 and 8, wherein a main shaft 100 of a sewing machine is connected through a link 101 with a presser bar 102 having a fabric presser foot 103 at its lower end. A rotation of the main shaft 100 allows the presser bar 102 to be moved upward and downward so that a stroke of the fabric presser foot 103 with respect to a needle plate 105 is predetermined to reduce the noise.

However, a problem normally arises when the fabric of a hard material is sewn, because a weight of the presser bar 102 having the fabric presser foot 103 and a biasing force of a spring 104 are directly transmitted to the needle plate 105 through the fabric and the noise is not reduced to a comfortable level or magnitude.

SUMMARY OF THE INVENTION

It is an object of the present invention to solve the afore-mentioned defect of the the prior art.

It is another object of the present invention to provide a device having an improved fabric presser foot which can be moved vertically independent of a reciprocating motion of a presser bar.

These and other objects of the invention are attained by a fabric presser foot device for a sewing machine comprising: a presser bar reciprocable in a vertical plane in response to a rotation of a main shaft of the sewing machine; a fabric presser foot mounted on a lower end of the presser bar, but slidable axially with respect to the presser bar; a biasing means for urging the fabric presser foot downward; and a presser bar driving means for moving the fabric pressure foot to a position where the fabric is pressed by the fabric pressure foot when a top thread is taken up by a cone point of a rotating hook located below a needle plate.

According to the invention, when the presser bar is moved downward in response to the rotation the main shaft, the fabric presser foot resiliently abuts upon the fabric to be sewn because the biasing force of the biasing means is directly applied to the fabric through the fabric presser foot which can be moved vertically on the presser bar. Thus, the noise is considerably reduced.

Other features and advantages of the present invention will be apparent from the following description taken in conjunction with the accompanying drawings, in which like reference characters designate the same or similar parts throughout the figures thereof.

DESCRIPTION OF PREFERRED EMBODIMENTS

A first embodiment of the invention will be explained with reference to FIGS. 1–4.

A main shaft 10 of a sewing machine cooperates with a presser bar driving means 20 for reciprocating a presser bar 11 in a vertical plane. The presser bar 11 is provided at its lower end with a U shaped fabric presser foot 13 which is movable individually on the presser bar 11.

Figure 6:
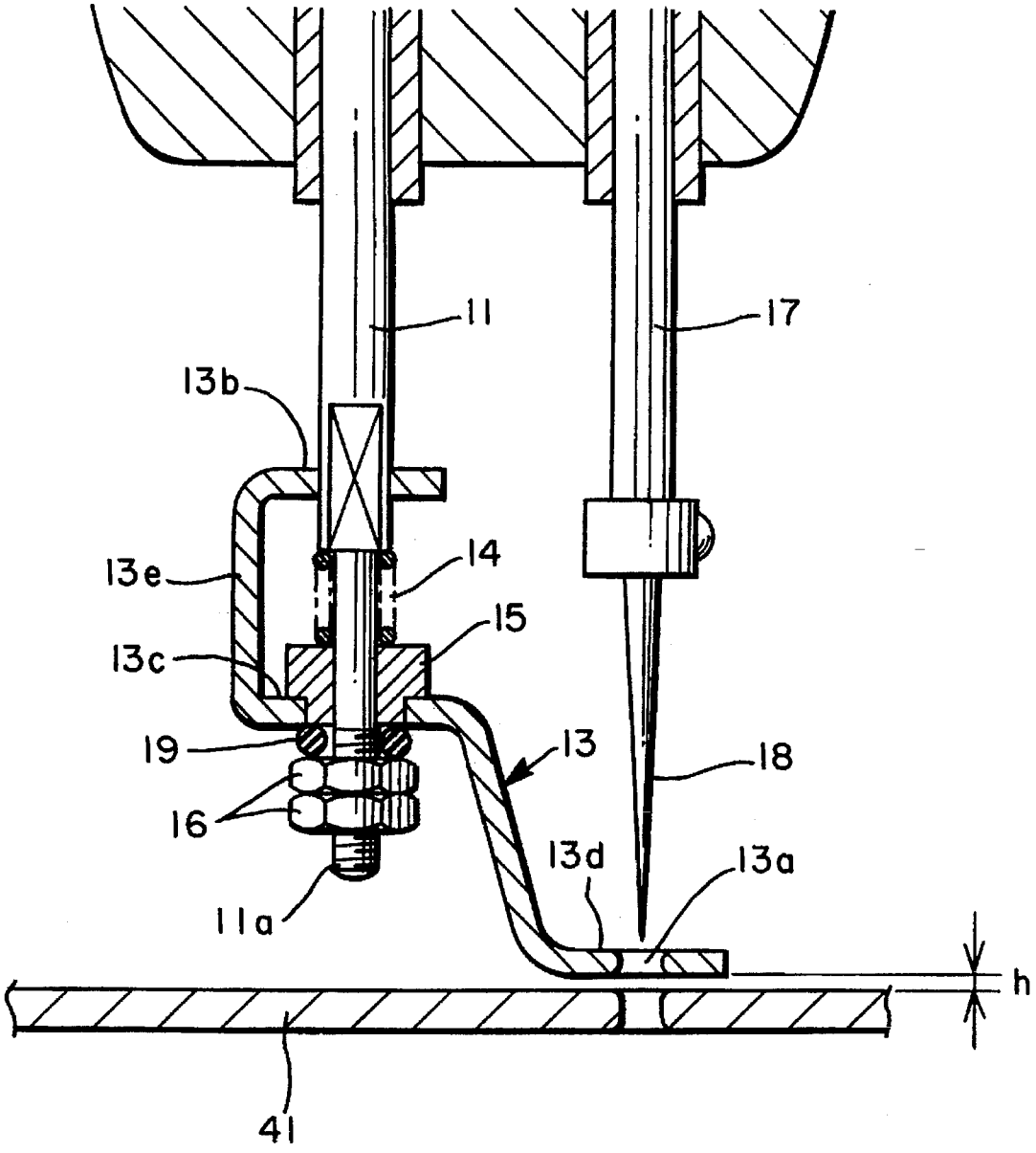
FIG. 6 is an enlarged view of a presser foot preferably used in the embodiments of the present invention.
Figure 7:
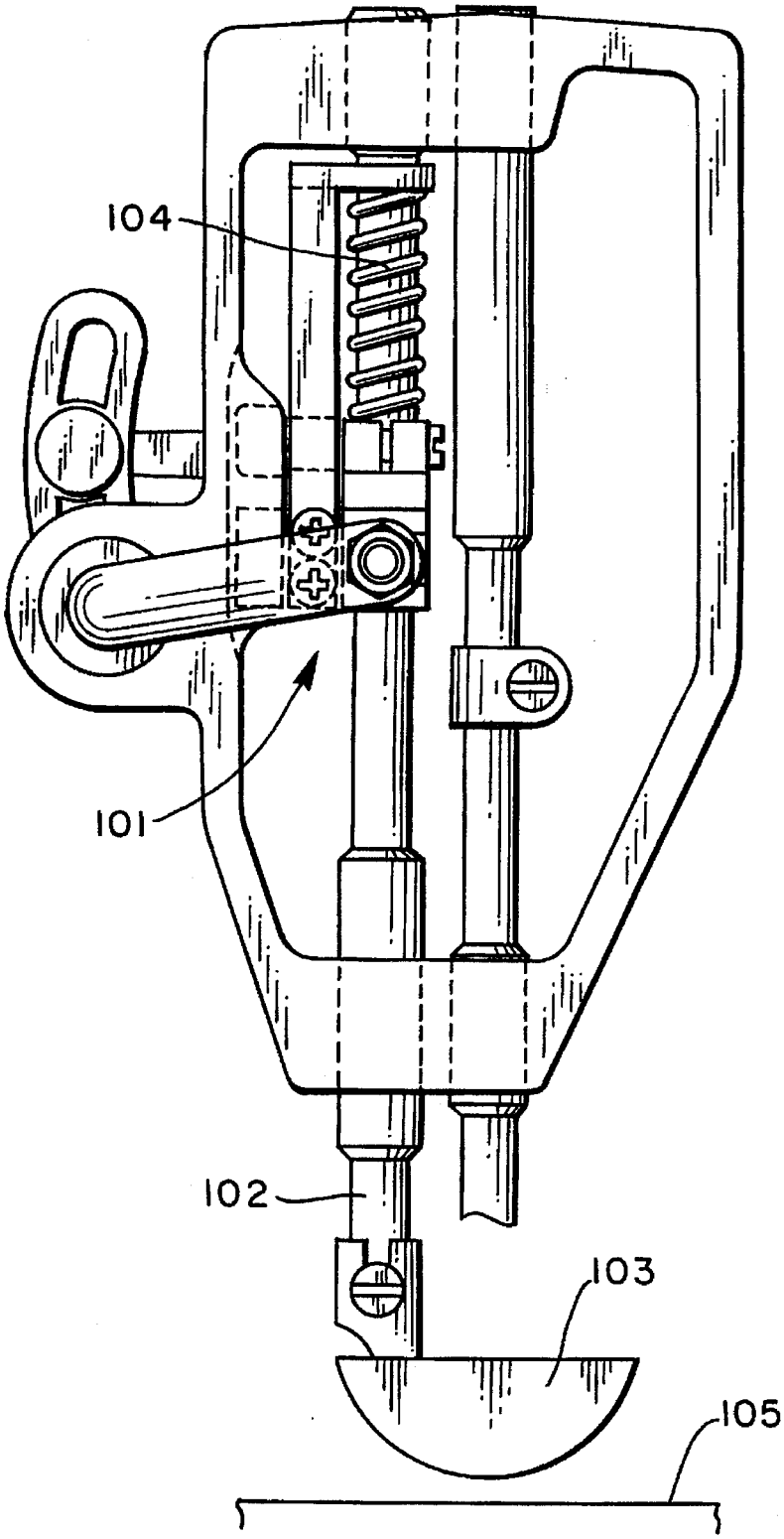
FIG. 7 PRIOR ART
FIG. 7 is a view showing a part of a sewing machine according to a prior art.
Figure 8:
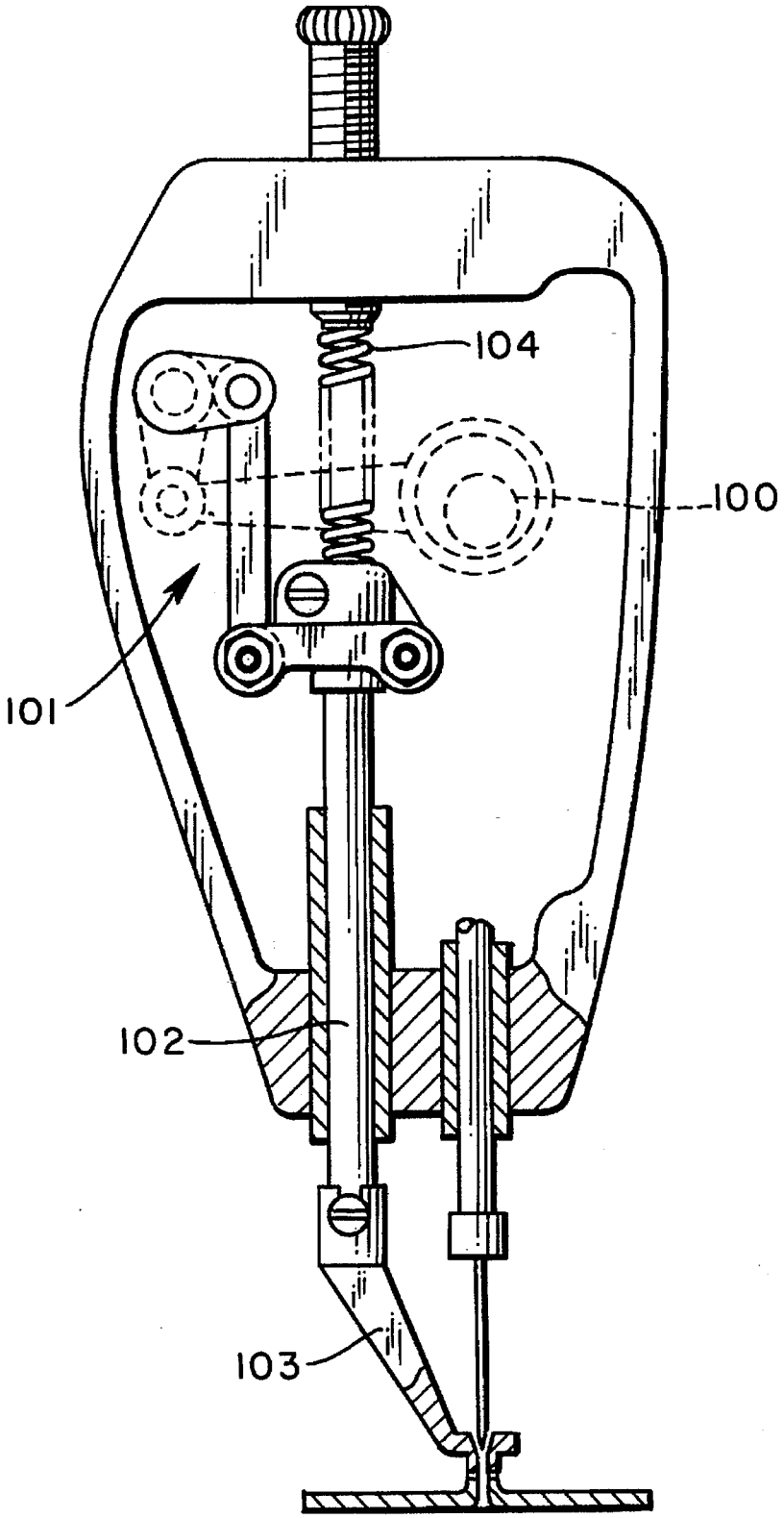
FIG. 8 PRIOR ART
FIG. 8 is a partially broken front view of the sewing machine of the prior art.

The fabric presser foot 13 has an upper plate portion **13*b*, a lower plate portion 13*c* apart therefrom, a fabric presser plate portion 13*d* extending from the lower plate portion 13*c*, and a connecting plate portion 13*e*. The fabric presser plate portion 13*d* has a hole 13*a* through which a needle 18 penetrates and the presser bar 11 passes through both the plate portions 13*b*, 13*c*. 15 indicate a guide fixed to the lower plate portion 13*c*, which prevents a tilt of the fabric presser foot 13 with respect to the presser bar 11. A compressed coil spring 14 is disposed between the guide 15 and a stepped portion of the presser bar 11 to urge the fabric presser foot 13 downward (refer to FIG. 6). A nut 16 is fastened to the lower end of the presser bar 11 to hold the fabric presser foot 13 via O-ring 19. The height h of the fabric presser foot 13 with respect to a needle plate 41 in FIG. 2 when the foot 13 takes a lowermost position can be adjusted by changing the position of the nut 16 with respect to the presser bar 11. 17** denotes a needle bar which is reciprocated in a vertical plane by a driving mechanism (not shown).

The presser bar driving means 20 includes a drive shaft 22 arranged in parallel with the main shaft 10 and connected therewith through an eccentric cam member 21, a first connecting rod 21*a* and a first eccentric member 22*a*. The drive shaft 22 is rotatably supported on a frame 12 of the sewing machine. The drive shaft 22 is connected with the presser bar 11 through a second eccentric member 22*b*, a second connecting rod 22*c*, a pin 23 and a third connecting rod 25. The third rod 25 is swingable with respect to the presser bar 11.

A rotatable hook 26 or shuttle is located below the needle plate 41 and a cone point 26*a* thereof will take up a top thread.

In operation the rotation of the main shaft 10 causes the first eccentric member 22*a* to perform an oscillatory motion about an axis of the drive shaft 22 by means of the eccentric cam member 21. The oscillation of the drive shaft 22 is transmitted to the second connecting rod 22*c* so that the third connecting rod 25 as well carries out an oscillatory motion as shown by arrows in FIGS. 3 and 4. Consequently, the presser bar 11 is moved vertically to periodically apply or release the pressure against a fabric 40 to be sewn by the fabric presser foot 13. The spring 14 assists in resiliently abutting the presser foot 13 upon the fabric 40 so as to reduce the noise.

Figure 1:
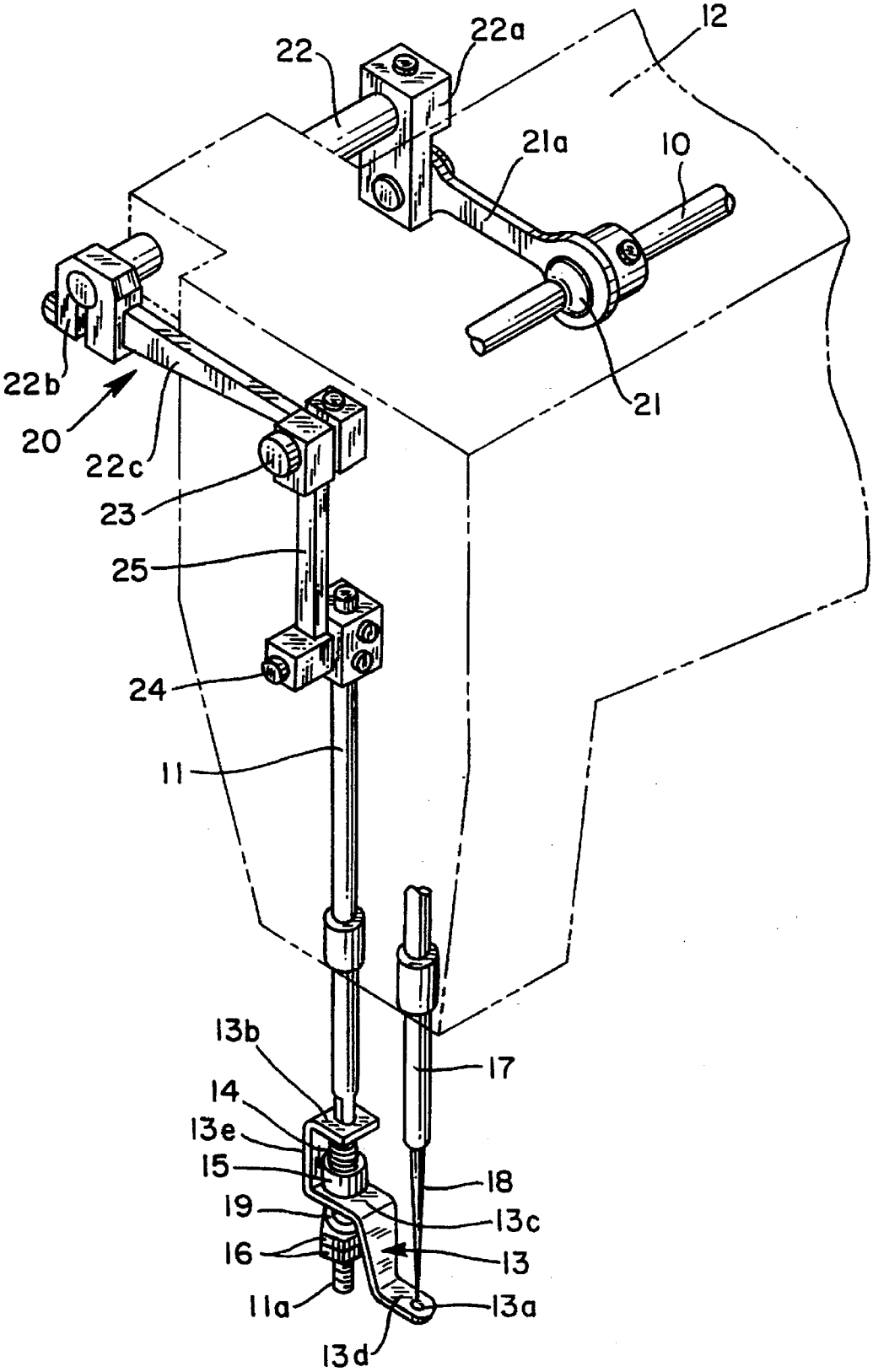
FIG. 1 is a perspective view of a fabric presser foot device of a sewing machine according to one example of the present invention.
Figure 2:
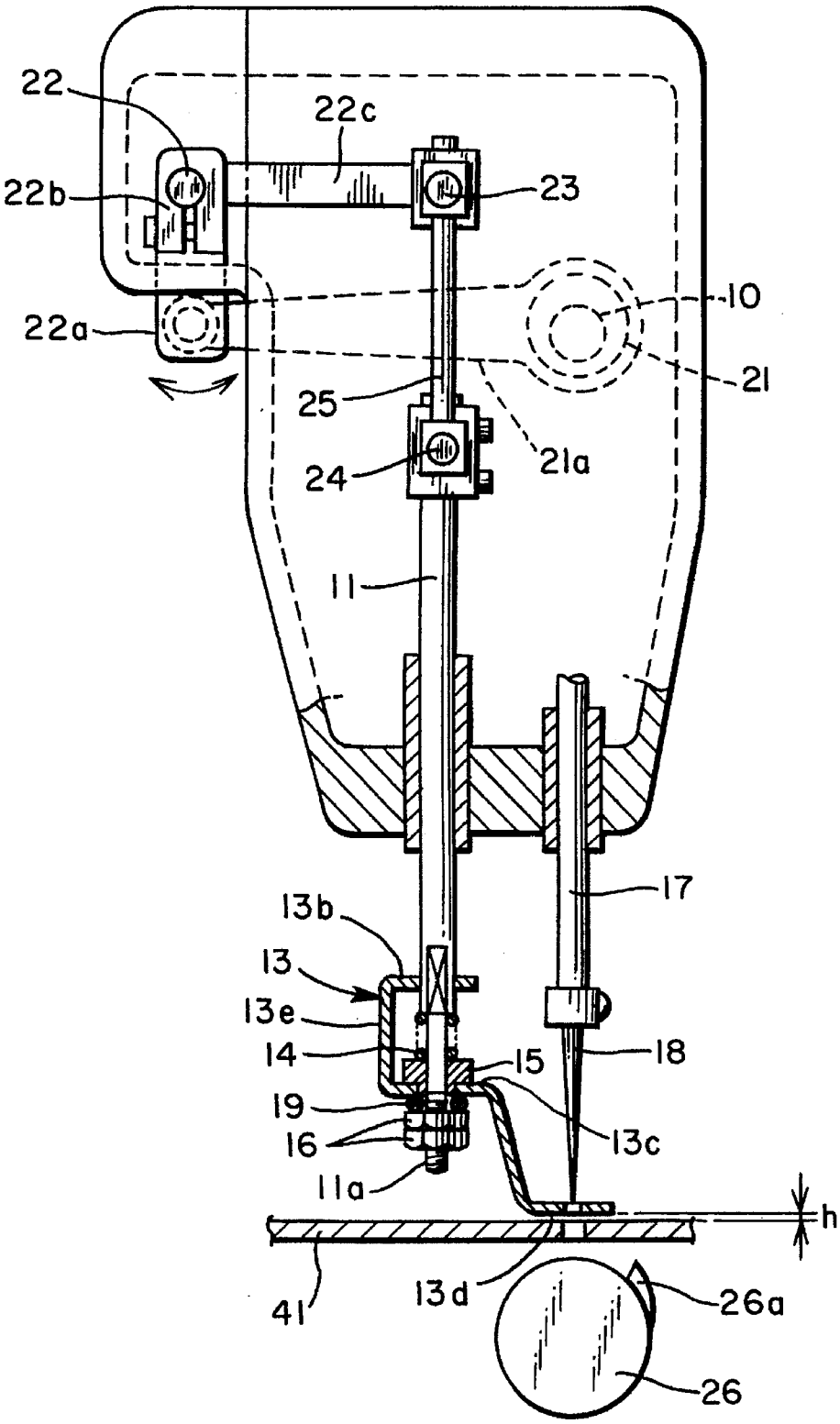
FIG. 2 is a partially broken side view of the fabric presser foot device.
Figure 3:
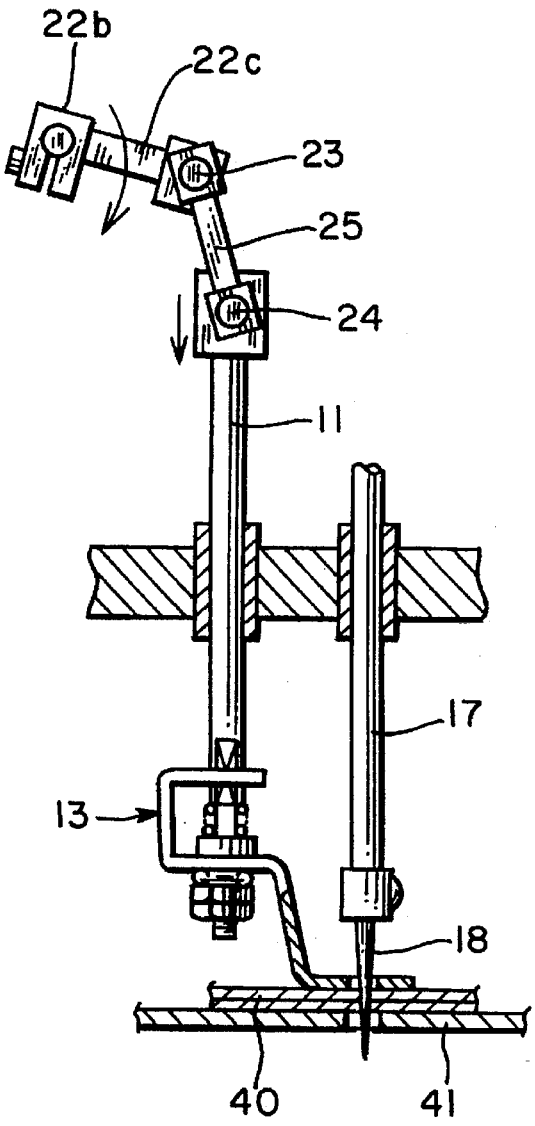
FIG. 3 is a view showing the fabric presser foot device in an operative position.
Figure 4:
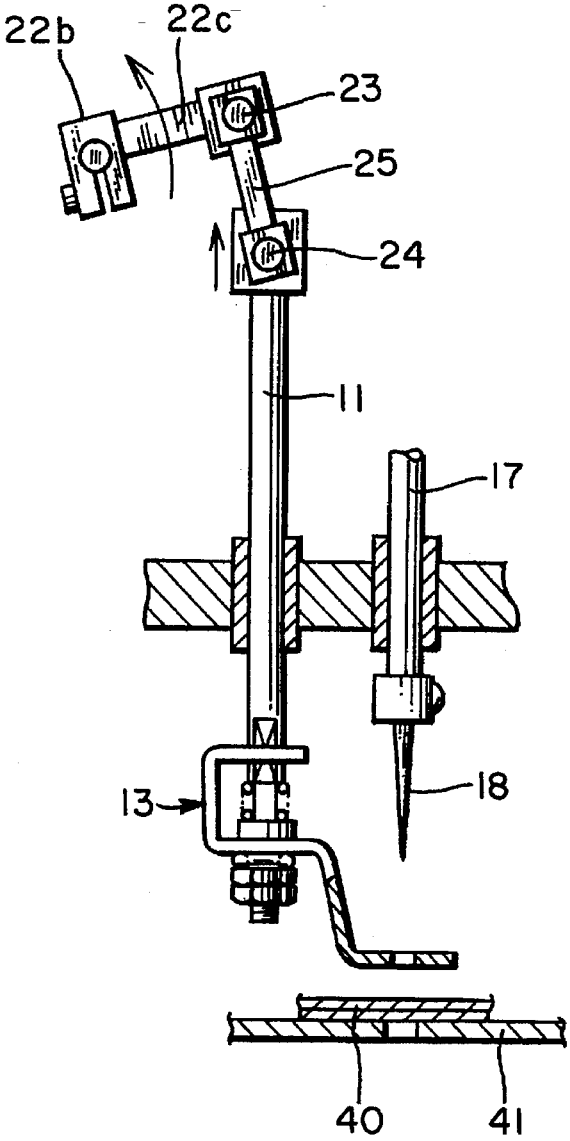
FIG. 4 is a view showing the fabric presser foot device in non-operative position.
Figure 5:
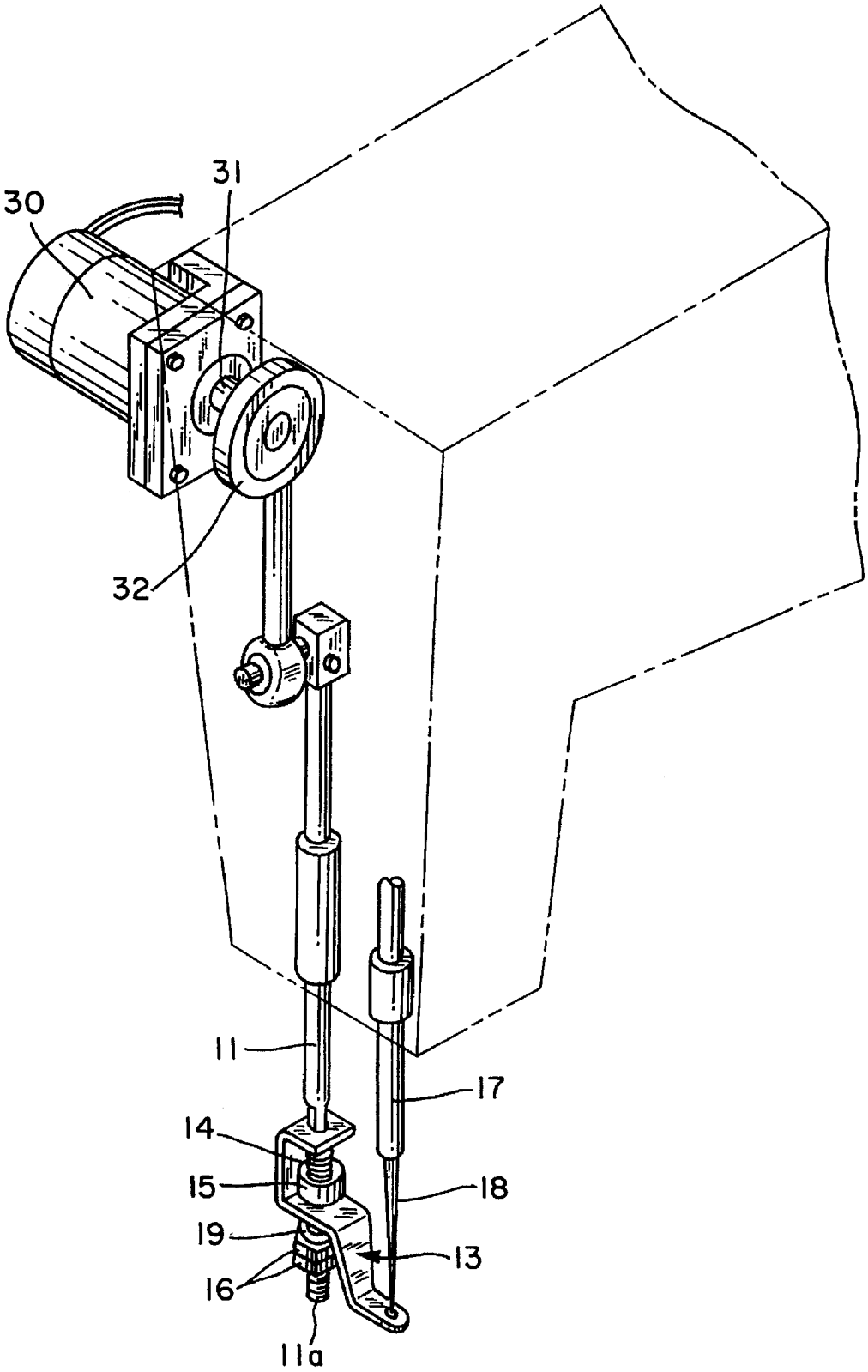
FIG. 5 is a perspective view showing another embodiment of the present invention.

FIG. 5 shows another embodiment of the present invention. In this case, a servomotor 30 is used instead of the link mechanism as shown in FIGS. 1–4, which has an eccentric cam member 32 secured to an output shaft thereof. The rotation of the output shaft of the servomotor 30 causes the presser bar 11 to be reciprocated vertically.

According to the present invention, since the fabric presser foot can be moved vertically independent of the vertical reciprocation of the presser bar so that the impact of abutment of the presser foot upon the fabric is weakened or absorbed by the spring, but which is enough to press the fabric against the needle plate. This assists in a reduction of the noise. When the thick fabric is to be sewn, the nut is further fastened to increase the height h in FIG. 2 and when the thin fabric is to be sewn the nut is loosened to decrease the height h in FIG. 2.

As many apparently widely different embodiments of the present invention can be made without departing from the spirit and scope thereof, it is to be understood that the invention is not limited to the specific embodiments thereof except as defined in the appended claims.

What is claimed is:

1. A fabric presser foot device for a sewing machine comprising:

a presser bar reciprocable in a vertical plane in response to a rotation of a main shaft of the sewing machine;

a fabric presser foot slidably mounted on a lower end of the presser bar;

a biasing means for urging the fabric presser foot downward; and a presser bar driving means for moving the fabric presser foot to a position where the fabric is pressed by the fabric presser foot when a top thread is taken up by a cone point of a rotating hook located below a needle plate;

wherein the fabric presser foot includes a pair of horizontal plate portions spaced away from each other through which the presser bar passes, a vertical plate portion connecting the horizontal plate portions, and a fabric pressing plate portion extending from one of the horizontal plate portions; said presser bar comprising a stepped portion and the biasing means is a coil spring disposed between the stepped portion of the presser bar and one of the horizontal plate portions.

2. A fabric presser foot device according to claim 1, wherein the presser bar is provided at its lower end with a threaded portion cooperating with a nut facing the lower horizontal plate portion so that a position of the nut with respect to the presser bar determines a height of the fabric pressing plate portion with respect to a needle plate of the sewing machine.

* * * * *